US008690385B2

(12) United States Patent
Ubaghs et al.

(10) Patent No.: US 8,690,385 B2
(45) Date of Patent: Apr. 8, 2014

(54) LIGHT-EMITTING ELECTRONIC TEXTILE WITH IMPROVED LIGHT DIFFUSION

(75) Inventors: Guy Wilhelmus Marie Ubaghs, Eindhoven (NL); Rabin Bhattacharya, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 65 days.

(21) Appl. No.: 13/391,642

(22) PCT Filed: Aug. 16, 2010

(86) PCT No.: PCT/IB2010/053679

§ 371 (c)(1),
(2), (4) Date: Feb. 22, 2012

(87) PCT Pub. No.: WO2011/027250

PCT Pub. Date: Mar. 10, 2011

(65) Prior Publication Data

US 2012/0155065 A1 Jun. 21, 2012

(30) Foreign Application Priority Data

Sep. 3, 2009 (EP) ..... 09169404

(51) Int. Cl.
*F21V 1/00* (2006.01)
*F21V 11/00* (2006.01)

(52) U.S. Cl.
USPC ..... 362/235; 362/103; 362/551; 362/311.01; 362/554

(58) Field of Classification Search
USPC ..... 362/543, 545, 235, 103, 249.01, 362/249.12, 551, 311.01, 554, 249.16, 362/311.06, 355, 570, 556
See application file for complete search history.

(56) References Cited

U.S. PATENT DOCUMENTS

| | | | | |
|---|---|---|---|---|
| 4,839,777 | A | 6/1989 | Janko et al. | |
| 2004/0252520 | A1 * | 12/2004 | Martineau et al. | 362/545 |
| 2006/0082987 | A1 * | 4/2006 | Dorsey et al. | 362/103 |
| 2008/0205035 | A1 * | 8/2008 | Asvadi et al. | 362/103 |
| 2011/0176326 | A1 * | 7/2011 | Stephan | 362/555 |

FOREIGN PATENT DOCUMENTS

| | | | | |
|---|---|---|---|---|
| WO | 2006129232 | A2 | 12/2006 | |
| WO | 2006129244 | A2 | 12/2006 | |
| WO | 2006129246 | A2 | 12/2006 | |
| WO | 2006129272 | A2 | 12/2006 | |
| WO | 2007141726 | A1 | 12/2007 | |
| WO | WO 2007141726 | A1 * | 12/2007 | |
| WO | 2008152574 | A1 | 12/2008 | |
| WO | WO 2009066216 | A1 * | 5/2009 | D05C 17/02 |

* cited by examiner

*Primary Examiner* — Anh Mai
*Assistant Examiner* — Kevin Quarterman
(74) *Attorney, Agent, or Firm* — John Salazar; Mark Beloborodov

(57) ABSTRACT

A light-emitting electronic textile (2) comprising a flexible component carrier (3) having a plurality of light-sources (4*a-c*) arranged thereon; a cover textile (5) arranged to allow passage through the cover textile (5) of light emitted by the light-sources (4*a-c*); and a light-diffusing member (6) arranged between the light-sources (4*a-c*) and the cover textile (5). The light-diffusing member (6) comprises a layered structure formed by a plurality of light-diffusing layers (12*a-c;* 16*a-b;* 19*a-c*), wherein adjacent light-diffusing layers in the layered structure are spaced apart at least in portions of the light-diffusing member (6) corresponding to positions of the light-sources (4*a-c*).

11 Claims, 3 Drawing Sheets

LIGHT-EMITTING ELECTRONIC TEXTILE WITH IMPROVED LIGHT DIFFUSION

FIELD OF THE INVENTION

The present invention relates to a light-emitting electronic textile and to a method for manufacturing such a light-emitting electronic textile.

BACKGROUND OF THE INVENTION

By integrating light-sources, such as light-emitting diodes (LEDs), into textile applications and thereby creating light-emitting electronic textiles, attractive visual effects can be achieved.

In general, currently available light-emitting electronic textiles have a rather low resolution, that is, the spacing between adjacent light-sources is relatively large. Furthermore, it has been found that end users often prefer that the light-emitting electronic textile gives the impression that the light-sources are not isolated spots of light.

For this reason, currently proposed light-emitting electronic textiles may be provided with a diffusing element arranged on top of the light-sources to achieve a more uniform output of light from the light-emitting electronic textile.

To even further improve the uniformity of the light output by the light-emitting electronic textile disclosed therein, WO 2006/129246 discloses a diffusing element formed by two layers of non-woven fabric with different densities.

However, there still appears to be room for improvement in the strive for achieving a light-emitting electronic textile which has textile-like mechanical properties, provides a good uniformity of the light output thereby and is easy to manufacture.

SUMMARY OF THE INVENTION

In view of the above-mentioned and other drawbacks of the prior art, a general object of the present invention is to provide an improved light-emitting electronic textile.

According to a first aspect of the present invention there is provided a light-emitting electronic textile comprising a flexible component carrier having a plurality of light-sources arranged thereon; a cover textile arranged to allow passage through the cover textile of light emitted by the light-sources; and a light-diffusing member arranged between the light-sources and the cover textile, the light-diffusing member comprising a layered structure formed by a plurality of light-diffusing layers, wherein adjacent light-diffusing layers in the layered structure are spaced apart at least in portions of the light-diffusing member corresponding to positions of the light-sources.

The flexible component carrier may, for example, comprise a flexible printed circuit board or a textile substrate comprising conductor lines. Such a textile substrate may, for example, be formed using interwoven conductive and non-conductive yarns.

The present invention is based on the realization that a light-emitting electronic textile exhibiting output of uniform light as well as textile-like mechanical properties can be achieved by diffusing the light output by the light-sources comprised in the light-emitting electronic textile using a multi-layer diffusing structure in which adjacent light-diffusing layers are spaced apart.

Because of the interfaces between light-diffusing layers and air, very efficient light-diffusion can be achieved while using less light-diffusing material than in known light-emitting electronic textiles. The use of less light-diffusing material may reduce absorption and back-scattering occurring in the light-diffusing member, which increases the output efficiency of the light-emitting electronic textile.

Furthermore, the spacing between adjacent light-diffusing layers facilitates relative movement between the adjacent light-diffusing layers, which provides for more textile-like mechanical properties of the light-emitting electronic textile.

The spacing between adjacent light-diffusing layers in the layered structure may advantageously be achieved by configuring the layered structure comprised in the light-diffusing member such that at least one of the light-diffusing layers is curved in such a way that the adjacent light-diffusing layers, at points along a line passing through the layered structure, exhibit mutually different radii of curvature. Hereby, the inherent elasticity of the light-diffusing layer(s) will result in a spring force acting to keep the adjacent light-diffusing layers spaced apart. This configuration of the layered structure comprised in the light-diffusing member can be achieved in various ways. Below, a few different exemplary embodiments will be provided, in which adjacent light-diffusing layers exhibit mutually different radii of curvature at points along a straight line passing through all the light-diffusing layers of the layered structure substantially in perpendicular to the light-diffusing member.

According to various embodiments, the layered structure may advantageously be formed by a flexible sheet being folded over itself at least once. This way of providing the layered structure is very well-suited to conventional textile production, which allows for a low manufacturing cost and a wide selection of potential manufacturing facilities.

Furthermore, the layered structure may be formed by at least two flexible sheet portions being joined together by at least one joint arranged along respective boundaries thereof.

Obviously, the flexible sheet portions may be joined together using any joining technique known to the skilled person, such as through sewing, welding, fusing etc.

According to one example, the at least one joint may be arranged between adjacent light-diffusing layers in the layered structure comprised in the light-diffusing member.

Moreover, the at least two flexible sheet portions that are joined together may be differently sized. By joining differently sized sheet portions in this manner, a bulge can be achieved, whereby adjacent light-diffusing layers can be spaced apart without using additional structures, such as spacing members.

Furthermore, at least one of the light-diffusing layers may be a textile layer. In particular, the layered structure may be formed by a textile sheet being folded over itself at least once, or by at least two differently sized flexible sheet portions being joined together along respective boundaries thereof, where at least one of the flexible sheet portions is a textile sheet portion.

By "textile" should, in the context of the present application, be understood a material or product that is wholly or partly made of textile fibers. The textile may, for example, be manufactured by means of weaving, braiding, knitting, crocheting, quilting, or felting. In particular, a textile may be woven or non-woven.

The light-diffusing member may advantageously comprise at least one sheet of a non-woven textile material, since non-woven textile materials are well suited for providing for a combination of efficient diffusion of light and the desired textile-like mechanical properties of the light-emitting electronic textile.

To provide for a high degree of robustness of the spacing between the adjacent light-diffusing layers in the portions of the light-diffusing member corresponding to positions of the light-sources, the adjacent light-diffusing layers in the layered structure may advantageously be spaced apart a distance corresponding to at least one quarter of a thickness of one of the adjacent light-diffusing layers at least somewhere in the layered structure.

To provide for an even higher degree of robustness of the spacing between the adjacent light-diffusing layers in the portions of the light-diffusing member corresponding to positions of the light-sources, the adjacent light-diffusing layers in the layered structure may advantageously be spaced apart a distance corresponding to at least one half of the thickness of one of the adjacent light-diffusing layers at least somewhere in the layered structure.

In this context it should be noted that light-diffusing layers made of various light-diffusing materials, such as a non-woven textile, may have fibers extending from the surface thereof. Such fibers sticking out from the surface should not be taken as being included in the thickness of the light-diffusing layer.

According to various embodiments, the cover textile may, furthermore, be arranged to enclose the flexible component carrier and the light-diffusing member. In particular, the cover textile may be configured to compress the light-diffusing member, whereby a robust and uniform spacing between adjacent light-diffusing layers in the layered structure can be achieved.

Moreover, the cover textile may comprise a reflective cover textile portion and a transmissive cover textile portion, the reflective cover textile portion having a higher optical reflectance and a lower optical transmittance than the transmissive cover textile portion. Through this configuration, the light emitted by the light-sources can be diffused even further, and the output of light from the light-emitting electronic textile can be controlled to portions thereof where output of light is desired.

To this end, the transmissive cover textile portion may advantageously be arranged to receive light having passed through the diffusing member directly from at least one of the light-sources.

According to a second aspect of the present invention, there is provided a method of manufacturing a light-emitting electronic textile, the method comprising the steps of: providing a flexible component carrier having a plurality of light-sources arranged thereon; providing a light-diffusing member comprising a layered structure formed by a plurality of light-diffusing layers on top of the light-sources; enclosing the flexible component carrier and the light-diffusing member by a cover textile in such a way that adjacent light-diffusing layers in the layered structure are spaced apart at least in portions of the light-diffusing member corresponding to positions of the light-sources.

The step of enclosing may comprise the steps of: providing the cover textile in the form of a substantially tube-shaped textile structure; and introducing the flexible component carrier and the light-diffusing member into the substantially tube-shaped textile structure.

Further embodiments and effects associated with this second aspect of the invention are largely analogous to those provided above for the first aspect of the present invention.

BRIEF DESCRIPTION OF THE DRAWINGS

These and other aspects of the present invention will now be described in more detail, with reference to the appended drawings showing currently preferred embodiments of the invention, wherein.

DETAILED DESCRIPTION OF THE EMBODIMENTS

In the following description, the present invention is described with reference to a light-emitting electronic textile in which the light-diffusing member is formed by one or several sheets of a non-woven textile material enclosed by tubular cover textile.

It should be noted that this by no means limits the scope of the invention, which is equally applicable to other light-emitting electronic textiles in which the cover textile is differently provided, for example as a one-sided cover being attached to the flexible component carrier. Furthermore, the light-diffusing member can be formed by a layered structure in any other suitable layered configuration formed by a plurality of light-diffusing layers, such as woven textile layers, foam layers or layers of different light-diffusing materials suitable for use in a light-emitting electronic textile.

Figures 1, 2:
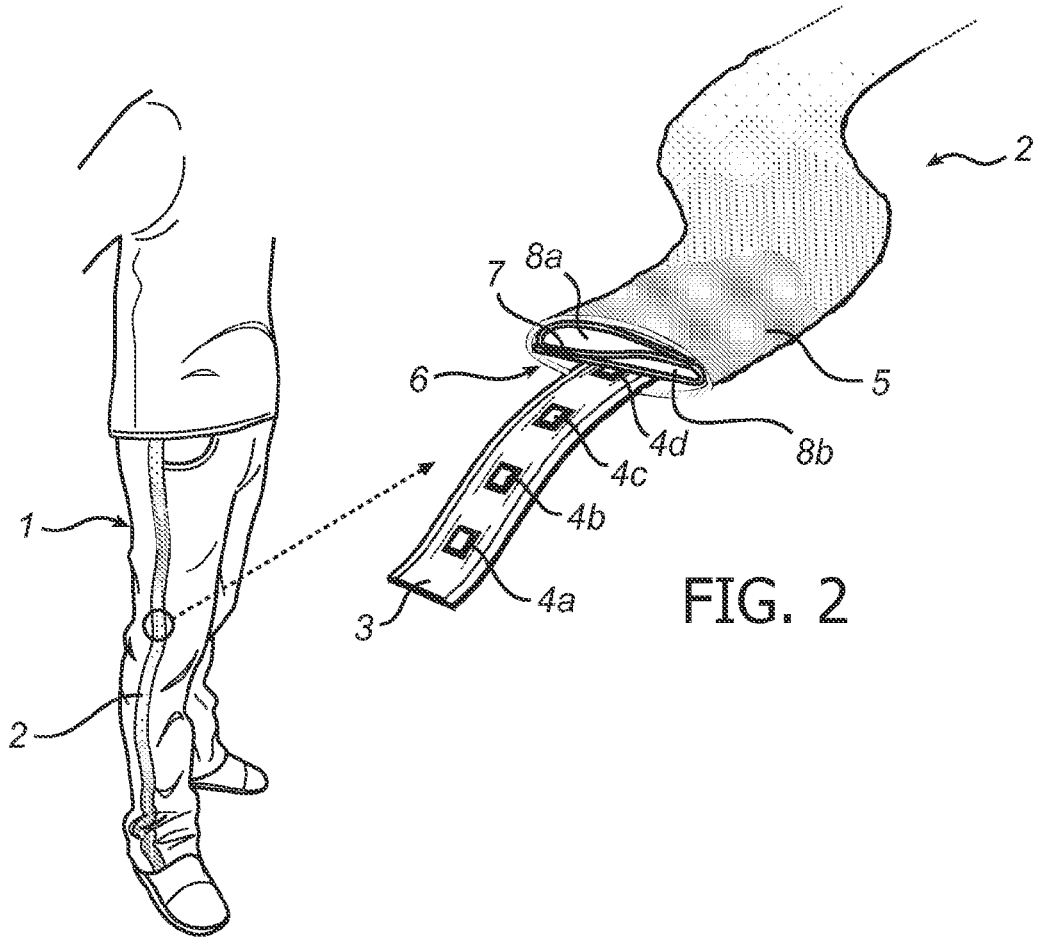
FIG. 1 schematically illustrates an exemplary application for various embodiments of the light-emitting electronic textile according to the present invention.
FIG. 2 is an enlarged perspective view of the light-emitting electronic textile in FIG. 1.

FIG. 1 schematically illustrates an exemplary application for various embodiments of the light-emitting electronic textile according to the present invention, in the form of a pair of trousers 1 with a stripe-shaped light-emitting electronic textile 2 running along the length of the legs of the trousers 1. As is schematically indicated in FIG. 1, the light-emitting electronic textile 2 emits light with, as it appears, continuously shifting color. This appearance is made possible through the spreading of light, referred to herein as light-diffusion, by the light-diffusing member comprised in the light-emitting electronic textile 2.

As is indicated in the drawing, FIG. 2 schematically shows an enlarged portion of the light-emitting electronic textile 2 in FIG. 1 in perspective in a partly cut view. Referring to FIG. 2, the light-emitting electronic textile 2 comprises a flexible component carrier 3 with a plurality of light-sources 4*a-d* arranged thereon, a cover textile 5 arranged to enclose the flexible component carrier 3 and a light-diffusing member 6 arranged between the light-sources 4*a-d* and the cover textile 5.

In the exemplary embodiment shown in FIG. 2, the flexible component carrier is provided in the form of a textile ribbon 3 with a plurality of LEDs 4*a-d* arranged thereon. The LEDs 4*a-d* are, although not visible in FIG. 2, electrically connected to conductive yarns extending along the length of the textile ribbon 3.

The light-diffusing member 6 comprises a layered structure in which at least one of the light-diffusing layers is curved in such a way that adjacent light-diffusing layers exhibit mutually different radii of curvature at points along a line passing through the layered structure of the light-diffusing member 6. The exemplary light diffusing member 6 visible in FIG. 2 is provided in the form of a non-woven textile sheet 7 that is that is folded over itself twice to form two air-gaps 8*a-b*. This configuration of the light-diffusing member 6 will be described in more detail below with reference to FIG. 3, which is a cross-section view of an exemplary embodiment of the light-emitting electronic textile 2 according to the invention.

Figure 3:
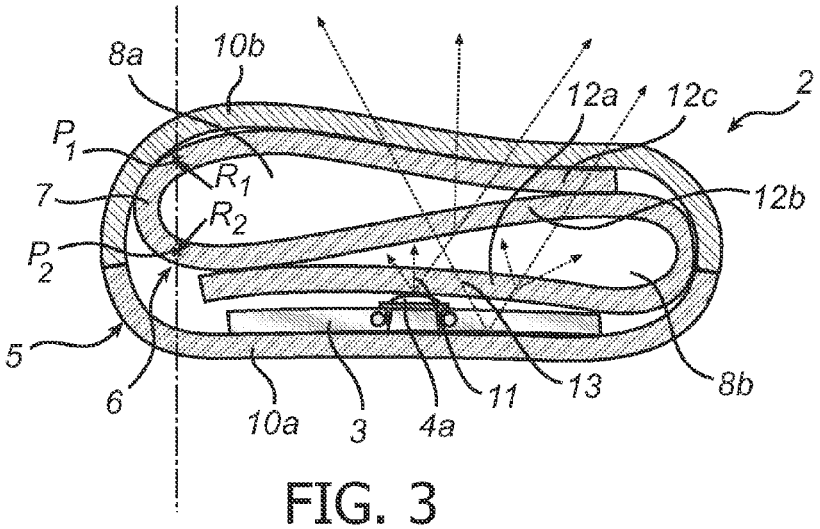
FIG. 3 is a schematic cross-section view of an exemplary embodiment of the light-emitting electronic textile in FIG. 1.

With reference to FIG. 3, an embodiment of the light-emitting electronic textile 2 in FIG. 1 is schematically shown, having substantially the same configuration as that indicated in FIG. 2. In the embodiment shown in FIG. 3, however, the cover textile 5 has a reflective cover textile portion 10*a* and a transmissive cover textile portion 10*b*. The reflective cover textile portion 10*a* has a reflective surface facing the flexible component carrier 3. The reflective surface may, for example, be achieved by providing a reflective cover textile portion 10*a* made of reflective fibers, such as glass-fibers, by providing the inner surface of the reflective cover textile portion 10*a* with a reflective coating or attaching a flexible reflector, such as a reflective foil, to the reflective cover textile portion 10*a*.

Referring again to FIG. 3, the light-diffusion achieved through the layered structure of the light-diffusing member 6 will now be described by partly following a single light-ray emitted by the LED 4*a*. As can be seen in FIG. 3, the light-ray 11 emitted by the LED 4*a* first hits the first light-diffusing layer 12*a* formed by the non-woven textile sheet 7 that is folded over itself. In the first light-diffusing layer 12*a*, the light-ray is diffused, that is, spread out, as is schematically indicated by the dotted arrows in FIG. 3. Then, as can be seen in FIG. 3, the diffused light-rays pass through the air-gaps 8*a-b* between the spaced apart light-diffusing layers 12*a-c*, and through the second 12*b* and third 12*c* light-diffusing layers and are further spread out. As can be understood by studying FIG. 3, a very efficient light-diffusion can be achieved with a relatively small amount of light-diffusing material. Furthermore, the light-diffusing layers 12*a-c* are free to move at least somewhat relative each other when the light-emitting electronic textile 2 is bent, which provides for a textile feel of the light-emitting electronic textile 2.

As is schematically shown in FIG. 3, some light, specifically indicated by the light-ray 13 in FIG. 3, will be directed towards the reflective cover textile portion 10*a*, where the light-ray 13 is reflected and diffused further before exiting the light-emitting electronic textile 2 through the transmissive cover textile portion 10*b*.

As was mentioned briefly above in connection with FIG. 2, the adjacent light-diffusing layers 12*a-c* are spaced apart through the spring force resulting from the folding of the non-woven textile sheet 7. As is schematically illustrated in FIG. 3, adjacent light-diffusing layers, in this case the top light-diffusing layer 12*c* and the middle light-diffusing layer 12*b* are both curved in such a way that they exhibit mutually different radii of curvature $R_1$, $R_2$ at points $P_1$, $P_2$ along a line 14 passing through the layered structure of the light-diffusing member 6.

Figure 4:
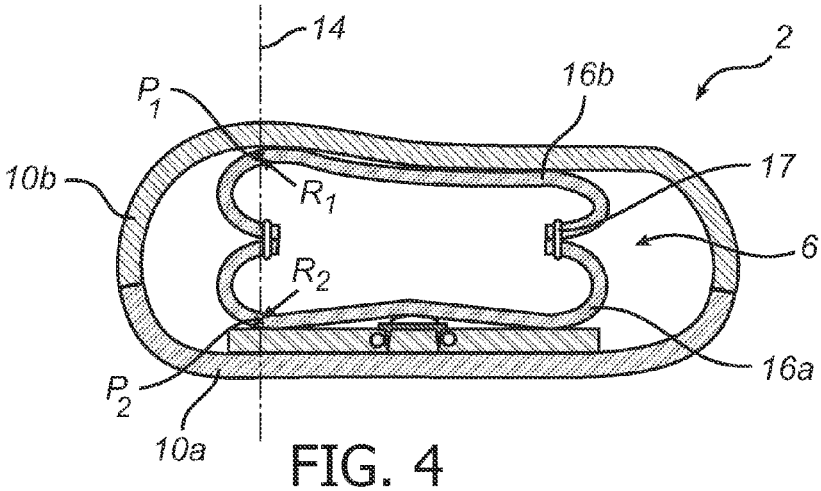
FIG. 4 is a schematic cross-section view of another exemplary embodiment of the light-emitting electronic textile in FIG. 1.

FIG. 4 is a schematic cross-section view of another exemplary embodiment of the light-emitting electronic textile in FIG. 1. This embodiment differs from that described with reference to FIG. 3 in that the light-diffusing member 6 comprises a layered structure formed by two flexible sheet portions 16*a-b* that are joined together by a joint 17 arranged between the light-diffusing layers formed by the two flexible sheet portions 16*a-b*. As is schematically illustrated in FIG. 4, this arrangement of the joint 17 results in adjacent light-diffusing layers 16*a-b* both being curved in such a way that they exhibit mutually different radii of curvature $R_1$, $R_2$ at points $P_1$, $P_2$ along a line 14 passing through the layered structure of the light-diffusing member 6.

Figure 5:
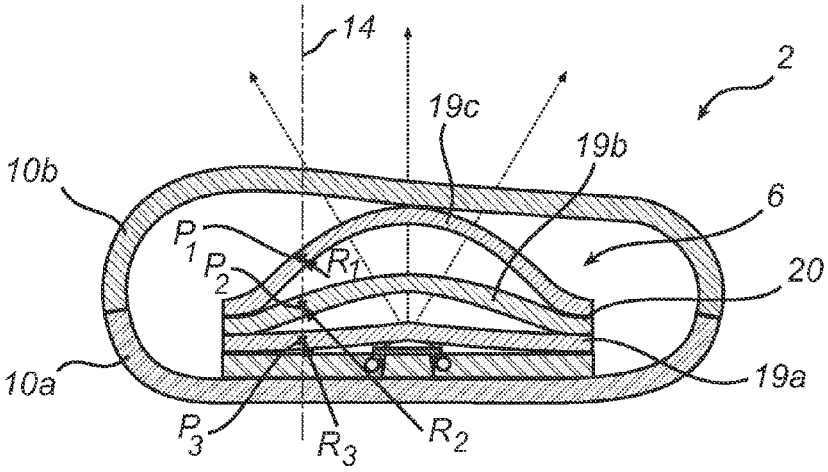
FIG. 5 is a schematic cross-section view of a further exemplary embodiment of the light-emitting electronic textile in FIG. 1.

FIG. 5 is a schematic cross-section view of further exemplary embodiment of the light-emitting electronic textile in FIG. 1. This embodiment differs from that described with reference to FIG. 4 in that the light-diffusing member 6 comprises a layered structure formed by three differently sized flexible sheet portions 19*a-c* that are joined together along their respective boundaries by a joint 20. Again, this configuration results in adjacent light-diffusing layers 19*a-b* both being curved in such a way that they exhibit mutually different radii of curvature $R_1$, $R_2$ at points $P_1$, $P_2$ along a line 14 passing through the layered structure of the light-diffusing member 6.

It should be noted that the arrows denoted $R_1$, $R_2$ etc in FIGS. 3-5 merely indicate the general directions between the associated intersection points $P_1$, $P_2$ and their respective centers of curvature.

Figure 6:
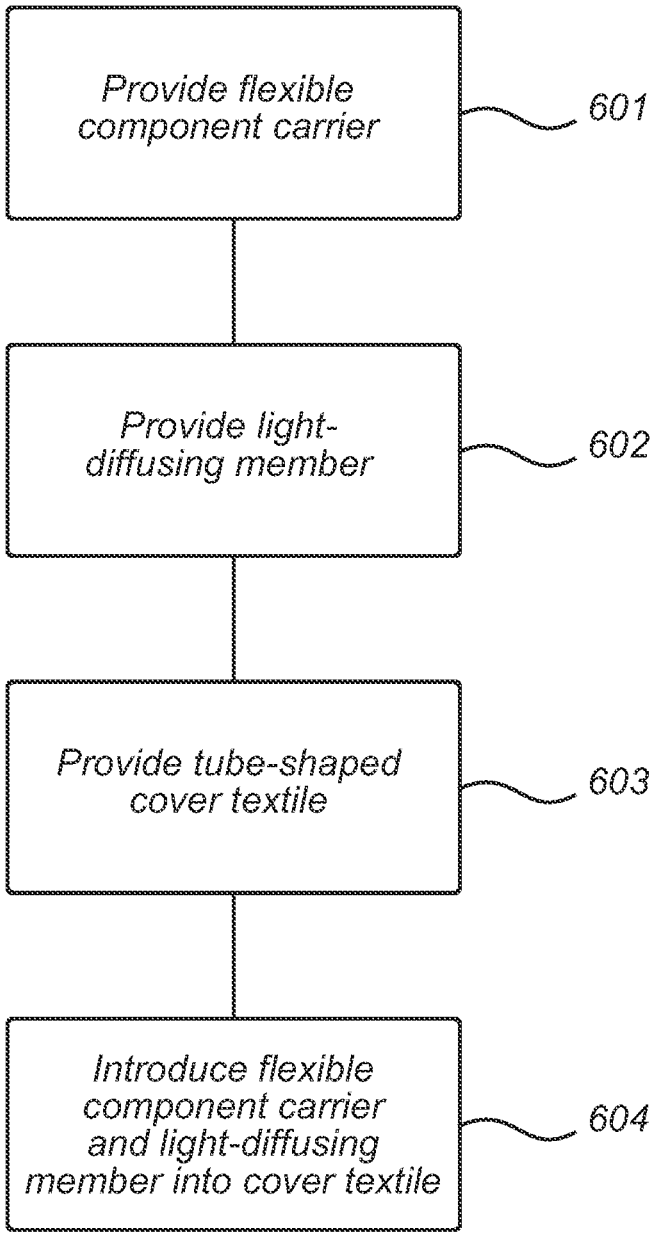
FIG. 6 is a flow-chart schematically illustrating a manufacturing method according to an embodiment of the invention.

An embodiment of a method for manufacturing a light-emitting electronic textile according to embodiments of the present invention will now be described with reference to the flow chart in FIG. 6 and to FIG. 2.

In a first step 601, a flexible component carrier 3 having a plurality of light-sources 4*a-d* arranged thereon is provided. Subsequently, a light-diffusing member 6 comprising a layered structure formed by a plurality of light-diffusing layers is provided on top of the flexible component carrier 3, to cover the light-sources 4*a-d*, in step 602. The light-diffusing member may advantageously be attached to the flexible component carrier through, for example, latching of the surface of the light-diffusing member to random points on the surface of the flexible component carrier 3, or using some kind of adhesion member, such as an adhesive or a connector for mechanical connection. A substantially tube-shaped cover textile 5 is provided in step 603, and finally the flexible component carrier 3 and the light-diffusing member 6 are introduced into the cover textile 5 in step 604.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage.

The invention claimed is:

1. A light-emitting electronic textile comprising:

a flexible component carrier having a plurality of light-sources arranged thereon;

a cover textile arranged to allow passage through the cover textile of light emitted by said light-sources; and a light-diffusing member arranged between said light-sources and said cover textile, said light-diffusing member comprising a layered structure formed by a plurality of light-diffusing layers in face to face adjacent relationship, wherein adjacent light-diffusing layers in said layered structure are spaced apart at least in portions of said light-diffusing member corresponding to positions of said light-sources, the adjacent layers in the layered structure are folded over forming the faced to faced adjacent layers with air gaps between respective face to face adjacent layers, wherein at least one of the light-diffusing layers is curved in such a way that the adjacent light-diffusing layers, at points along a line passing through the layered structure substantially is perpendicular to the light diffusing member exhibit mutually different radii of curvature.

2. The light-emitting electronic textile according to claim 1, wherein said layered structure is formed by a flexible sheet being folded over itself at least once.

3. The light-emitting electronic textile according to claim 1, wherein said layered structure is formed by at least two flexible sheet portions being joined together along respective boundaries thereof.

4. The light-emitting electronic textile according to claim 3, wherein said at least two flexible sheet portions are differently sized.

5. The light-emitting electronic textile according to claim 1, wherein at least one of said light-diffusing layers is a textile layer.

6. The light-emitting electronic textile according to claim 5, wherein said light-diffusing member comprises at least one sheet of a non-woven textile material.

7. The light-emitting electronic textile according to claim 1, said adjacent light-diffusing layers in the layered structure are spaced apart a distance corresponding to at least a quarter of a thickness of one of said adjacent light-diffusing layers.

8. The light-emitting electronic textile according to claim 1, wherein said cover textile is arranged to at least partly enclose the flexible component carrier and the light-diffusing member.

9. The light-emitting electronic textile according to claim 8, wherein said cover textile is configured to compress the light-diffusing member.

10. The light-emitting electronic textile according to claim 8, wherein said cover textile comprises a reflective cover textile portion and a transmissive cover textile portion, the reflective cover textile portion having a higher optical reflectance and a lower optical transmittance than the transmissive cover textile portion.

11. The light-emitting electronic textile according to claim 10, wherein said transmissive cover textile portion is arranged to receive light having passed through said diffusing member directly from at least one of said light-sources.

* * * * *